US009163451B1

(12) United States Patent
Curry

(10) Patent No.: US 9,163,451 B1
(45) Date of Patent: Oct. 20, 2015

(54) GARAGE OPENING PRIVACY SCREEN SYSTEMS

(71) Applicant: Helen Curry, Sun City, CA (US)

(72) Inventor: Helen Curry, Sun City, CA (US)

( * ) Notice: Subject to any disclaimer, the term of this patent is extended or adjusted under 35 U.S.C. 154(b) by 121 days.

(21) Appl. No.: 14/085,737

(22) Filed: Nov. 20, 2013

Related U.S. Application Data

(60) Provisional application No. 61/736,159, filed on Dec. 12, 2012.

(51) Int. Cl.

| | |
|---|---|
| ***E06B 3/48*** | (2006.01) |
| ***E06B 9/24*** | (2006.01) |
| *E06B 9/04* | (2006.01) |
| *E06B 9/54* | (2006.01) |
| *E06B 3/46* | (2006.01) |
| *E06B 3/42* | (2006.01) |
| *A47G 5/00* | (2006.01) |
| *E06B 3/32* | (2006.01) |

(52) U.S. Cl.

CPC ... *E06B 9/24* (2013.01); *A47G 5/00* (2013.01); *E05Y 2900/106* (2013.01); *E06B 3/32* (2013.01); *E06B 3/42* (2013.01); *E06B 3/46* (2013.01); *E06B 3/4636* (2013.01); *E06B 3/4645* (2013.01); *E06B 9/04* (2013.01); *E06B 2009/543* (2013.01)

(58) Field of Classification Search

CPC ..... E06B 9/24; E06B 9/52; E06B 2009/543; E06B 9/04; E06B 3/32; E06B 3/42; E06B 3/46; E06B 3/4636; E06B 9/4645; A47G 5/00; E05Y 2900/106

USPC ..... 160/119, 117, 118, 181, 184, 201, 202, 160/216, 222, 223; 49/425

See application file for complete search history.

(56) References Cited

U.S. PATENT DOCUMENTS

| | | | | | |
|---|---|---|---|---|---|
| RE23,576 | E | * | 11/1952 | Klein | 49/420 |
| 3,064,723 | A | * | 11/1962 | Paillard et al. | 160/194 |
| 3,452,477 | A | * | 7/1969 | Sassano | 49/116 |
| 3,642,051 | A | * | 2/1972 | Goldner | 160/197 |
| 3,693,293 | A | * | 9/1972 | Egan et al. | 49/56 |
| 3,858,638 | A | * | 1/1975 | Soeffker | 160/102 |
| 3,911,991 | A | * | 10/1975 | Malferrari | 160/202 |
| 4,141,403 | A | * | 2/1979 | Church | 160/201 |
| 4,192,100 | A | * | 3/1980 | Klema | 49/404 |
| 4,231,412 | A | * | 11/1980 | Nowak | 160/213 |
| 4,242,836 | A | * | 1/1981 | Anderson | 49/63 |
| 4,365,441 | A | * | 12/1982 | Davidson | 49/63 |
| 4,370,826 | A | * | 2/1983 | Davidson | 49/63 |
| 4,537,237 | A | | 8/1985 | Sepulveda | |
| 4,537,273 | A | * | 8/1985 | Funabashi | 180/229 |
| 4,574,860 | A | * | 3/1986 | Weiss | 160/118 |
| 4,619,074 | A | * | 10/1986 | Leung et al. | 49/143 |
| 4,635,699 | A | * | 1/1987 | Kauffman et al. | 160/211 |
| 5,105,868 | A | * | 4/1992 | Riise | 160/90 |
| 5,163,494 | A | * | 11/1992 | MacNeil et al. | 160/201 |
| 5,908,064 | A | * | 6/1999 | Bruce | 160/202 |

(Continued)

*Primary Examiner* — Katherine Mitchell
*Assistant Examiner* — Johnnie A Shablack
(74) *Attorney, Agent, or Firm* — RG Patent Consulting, LLC; Rachel Gilboy

(57) ABSTRACT

A privacy screen assembly is a set of auxiliary screen panels for covering a garage door opening that provides a view from the inside looking out but appears to be an opaque garage door from the outside, and yet, provides ventilation through the screen panels. The panel is useful for privacy and ventilation while providing an open clear view looking out or for concealing the interior contents in the event that the roll-up garage door is disabled in the open position. The panels may be locked to provide a degree of security.

10 Claims, 7 Drawing Sheets

(56) References Cited

U.S. PATENT DOCUMENTS

| | | | | |
|---|---|---|---|---|
| 6,003,583 | A * | 12/1999 | Lacoste et al. | 160/122 |
| 6,004,649 | A * | 12/1999 | Nagata | 428/107 |
| 6,041,551 | A * | 3/2000 | Aspenwall | 49/425 |
| 6,161,334 | A * | 12/2000 | Goodin | 49/125 |
| 6,209,613 | B1 * | 4/2001 | Forry | 160/199 |
| 6,289,643 | B1 * | 9/2001 | Bonar | 52/207 |
| 6,330,763 | B1 * | 12/2001 | Kern et al. | 49/231 |
| 6,336,247 | B1 * | 1/2002 | Schnoor | 16/87.6 R |
| 6,360,487 | B1 * | 3/2002 | Kern et al. | 49/231 |
| 6,880,610 | B1 * | 4/2005 | Bush | 160/202 |
| 6,892,783 | B1 * | 5/2005 | Comeau et al. | 160/126 |
| 6,923,238 | B2 * | 8/2005 | Kern et al. | 160/197 |
| 7,021,007 | B2 * | 4/2006 | Jacobs | 49/425 |
| 7,174,944 | B1 * | 2/2007 | Clark et al. | 160/197 |
| 7,270,165 | B1 * | 9/2007 | Chuang | 160/197 |
| 7,299,852 | B1 * | 11/2007 | Chuang | 160/197 |
| 7,331,369 | B2 * | 2/2008 | Cordova | 160/23.1 |
| 7,424,935 | B1 * | 9/2008 | Smith | 187/333 |
| 7,451,802 | B2 * | 11/2008 | Cianciolo et al. | 160/211 |
| 7,484,286 | B2 * | 2/2009 | Fowler | 29/401.1 |
| 7,685,774 | B2 * | 3/2010 | Thielmann | 49/411 |
| 7,712,258 | B2 * | 5/2010 | Ewing et al. | 49/410 |
| 7,730,929 | B2 * | 6/2010 | Perron | 160/202 |
| 7,743,558 | B2 * | 6/2010 | Jakob-Bamberg et al. | 49/409 |
| 7,762,305 | B2 * | 7/2010 | Huang | 160/201 |
| 7,779,578 | B2 * | 8/2010 | Gray | 49/506 |
| 7,958,926 | B2 * | 6/2011 | Colson et al. | 160/184 |
| 8,297,334 | B2 * | 10/2012 | Chu | 160/222 |
| 8,402,699 | B2 * | 3/2013 | Henriott | 52/36.1 |
| 8,439,098 | B1 * | 5/2013 | Jones et al. | 160/116 |
| 8,579,006 | B2 * | 11/2013 | Levin | 160/184 |
| 8,590,244 | B2 * | 11/2013 | O'Riordan | 52/407.4 |
| 8,733,024 | B2 * | 5/2014 | Vogel et al. | 49/501 |
| 8,833,427 | B2 * | 9/2014 | Kazuma | 160/197 |
| 8,991,099 | B1 * | 3/2015 | Erskine | 49/127 |
| 2007/0158036 | A1 * | 7/2007 | Lin | 160/197 |
| 2008/0006375 | A1 * | 1/2008 | Meadows | 160/371 |
| 2010/0071857 | A1 * | 3/2010 | Hung | 160/97 |
| 2011/0162167 | A1 * | 7/2011 | Blais | 16/91 |
| 2011/0314738 | A1 * | 12/2011 | Harriott et al. | 49/50 |
| 2012/0117881 | A1 * | 5/2012 | Seymour et al. | 49/130 |
| 2013/0180675 | A1 * | 7/2013 | Bates et al. | 160/381 |
| 2013/0239318 | A1 * | 9/2013 | Wang | 4/608 |
| 2013/0306247 | A1 * | 11/2013 | Spurgers | 160/12 |
| 2014/0352220 | A1 * | 12/2014 | Rees | 49/164 |
| 2015/0068124 | A1 * | 3/2015 | Fornasari | 49/130 |

* cited by examiner

GARAGE OPENING PRIVACY SCREEN SYSTEMS

CROSS-REFERENCE TO RELATED APPLICATION

The present application is related to and claims priority from prior provisional application Ser. No. 61/736,159, filed Dec. 12, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of ventilated garage doors and more specifically relates to a garage opening privacy screen system.

2. Description of the Related Art

Garage doors are used on enclosed garages to protect vehicles parked inside from the elements, as well as from vandalism or theft. The modern home garages are often multipurpose spaces that sometimes do not include parking vehicles. Garages are used as hobby shops, repair shops, home business shops, and even social gathering places because of the large floor spaces. Many people like to open up their garage door to see outside while letting air pass through. Typically, garage doors do not allow ventilation in warm weather and so the space becomes uncomfortable for engaging in the previously mentioned activities. Because garages are often used to store expensive tools, equipment, hobby items, or other costly belongings that cannot be stored inside the house, many homeowners are not comfortable with opening the garage door and exposing the stored items to people on the street. In a majority of locations, costly belongings would not last long because of thieves, if the roll-up door was left open. Similarly, a person working in a garage with such items or having a social gathering in the garage may not feel comfortable with the view being exposed to the street.

Most modern garage doors are operated electrically with a remote control. Garage rollup doors actually have many moving parts that require maintenance. From time to time, garage rollup doors experience component failure and become stuck in the open or partially open position, exposing the items inside to the street. Power failure can also leave the doors inoperative and often do, with the door in the open position. A convenient solution to these problems is needed.

Various attempts have been made to solve the above-mentioned problems such as those found in U.S. Pat. No. 4,141,403 to Rocco L. Church, U.S. Pat. No. 7,484,286 to Darrell Fowler, U.S. Pat. No. 5,163,494 to Vincent A. MacNeil, U.S. Pat. No. 4,231,412 to Eugene F. Nowak, U.S. Pat. No. 4,537, 237 to Frank J. Sepulveda, and U.S. Pat. No. 4,574,860 to Otto Weiss. This art is representative of ventilated garage doors. None of the above inventions and patents, taken either singly or in combination, is seen to describe the invention as claimed.

Ideally, a garage opening privacy screen system should provide ventilation, privacy and security, and yet, would operate reliably and be manufactured at a modest expense. Thus, a need exists for a reliable garage opening privacy screen system to avoid the above-mentioned problems.

BRIEF SUMMARY OF THE INVENTION

In view of the foregoing disadvantages inherent in the known ventilated garage door art, the present invention provides a novel garage opening privacy screen system. The general purpose of the present invention, which will be described subsequently in greater detail, is to provide privacy by being able to see out from the inside but not being able to see in from the outside while providing a measure of security for the user.

A garage opening privacy screen system as disclosed herein, in preferred embodiments, may comprise a privacy screen assembly having a top screen track with a first wheel channel, a bottom screen track having a second wheel channel, a plurality of screen panels each having a top rail, a bottom rail, a left stile, a right stile, a plurality of upper rail wheels, a plurality of lower rail wheels, a privacy screen, and a screen panel lock having a first half and a second half. The top screen track of the privacy screen assembly is removably fastened to the garage door opening header and the first wheel channel is centrally and longitudinally located in the downward facing side of the top screen track. The bottom screen track of the privacy screen assembly is removably fastened to the garage opening floor such that the top screen track and the bottom screen track are coplanar with each other and are parallel planar to the existing garage roll-up door when the garage roll-up door is in the closed position. The top screen track and the bottom screen track may further comprise multiple U-channels which may be parallel to each other.

The plurality of lower rail wheels of each of the screen panels roll in the multiple U-channels of the second wheel channel parallel planar to each other. The second wheel channel is centrally and longitudinally located in the upward facing side of the bottom screen track. Each of the top rail, the bottom rail, the left stile, and the right stile form a rectangular border for each screen panel, each having a rectangular screen opening within the interior space formed by the rectangular border. The top rail, the bottom rail, the left stile, and the right stile of each screen panel may comprise metal-alloy square tubing such that each screen panel resists tortional twisting. The top rail, the bottom rail, the left stile, and the right stile of each screen panel may comprise aluminum such that the screen panels are light weight and easy for the user to manipulate. The privacy screen may comprise a thin gauge expanded metal-alloy. In some embodiments, the privacy screen may comprise textile or fabric having a wide enough mesh that a user may be able to see through from one direction but not from the opposite side. The privacy screen is non-removably attached to the inner periphery of the rectangular border and is co-planar to the rectangular border.

The plurality of upper rail wheels are centrally and axially mounted within the top longitudinal side of the top rails such that the wheels are partially exposed above the planar surface formed by the top longitudinal side of the top rails. The lower rail wheels may be centrally and axially mounted within the bottom longitudinal edge of the bottom rails such that the wheels are partially exposed below the planar surface formed by the bottom longitudinal edge of the bottom rails. The upper rail wheels and the lower rail wheels for each of the screen panels are aligned linearly on each panel and coplanar from panel to panel. The upper and lower rail wheels of each screen panel may be able to roll in the multiple U-channels of the first and second wheel channels. The screen panels are divided such that about three screen panels (more or less may be used in alternate embodiments) are extended and alternately retracted from the inside left garage trimmer and about three screen panels (more or less may be used in alternate embodiments) are extended and alternately retracted from the inside right garage trimmer. The plurality of screen panels, when in an open condition, comprise three panels adjacently parallel planar on the left side of the garage door opening and three panels adjacently parallel planar on the right side of the garage door opening. As such, the first half of the screen panels are located on the left side of the garage door opening and a second half of the screen panels are located on the right side of the garage door opening when more screen panels are used.

The screen panels may comprise hinges in some embodiments and may be able to fold accordion style into a storage position with each panel of the left side of the garage door opening parallel planar to each other and each panel of the right side of the garage door opening parallel planar to each other. The plurality of screen panels are rollably located between and confined within the plane between the top screen track and the bottom screen track via the upper rail wheels and the lower rail wheels respectively, such that each of the screen panels are parallel planar to each other and able to roll linearly within the first wheel channel and the second wheel channel to close the garage door opening. The screen panels may comprise screen panel limiters such that when the screen panels are extended to the closed position, a gap between the screen panels is not present and the panels are locked together on both ends. Those with ordinary skill in the art will now appreciate that upon reading this specification and by their understanding the art of doors as described herein, methods of fastening, sliding, opening, closing will be understood by those knowledgeable in such art.

The screen panels may provide a privacy barrier having a mesh such that the user is able to see outwardly through the privacy screen (from inside the garage) and alternately not able to see inwardly through the privacy screen (from outside the garage). The first half of the screen panel lock is mounted in the left stile of a first the screen panel and the second half of the screen panel lock is mounted in the right stile of a second screen panel such that the first screen panel and the second screen panel are able to be locked together when the first screen panel and the second screen panel are in the centermost position within the garage door opening. The garage door opening is fully open and unobstructed by the screen panels when the screen panels are in the retracted position. The screen panels are also auxiliary to the roll-up garage door. The privacy screen assembly is useful for rollably aligning the plurality of screen panels end to end within the garage door opening and locking together to provide a privacy screen while having air flow-through and a one-way view from the inside looking out and providing a degree of security for the user.

The garage opening privacy screen system may comprise a kit that includes a top screen track, a bottom screen track, a plurality of assembled screen panels, and at least one set of user instructions. Manual or powered versions may be available.

A method of using the garage opening privacy screen system may comprise the steps of extending the screen panels on the left side of a garage door opening toward the center of the opening, extending the screen panels on a right side of the garage door opening toward the center of the garage door opening to cover the opening, locking the screen panels on the left side of the garage door opening with the screen panels on the right side of the garage door opening via the screen panel lock, using the screen panels, unlocking the screen panels, and retracting the screen panels on the left side of the garage door opening and the right side of the garage door opening for storage. The look (of the garage door) remains the same. The installation is an inside mount. The installation not only applies to new construction but any and all pre-existing garage doors.

The present invention holds significant improvements and serves as a garage opening privacy screen system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, garage opening privacy screen systems, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to ventilated garage doors and more particularly to a garage opening privacy screen system as used to improve the privacy and security of the interior of a garage while the (existing) roll-up garage door is open.

Generally speaking, a privacy screen assembly is a set of auxiliary screen panels for covering a garage door opening that provides a view from the inside looking out but appears to be an opaque garage door from the outside, and yet, provides ventilation through the screen panels. The screen panel assembly is useful for privacy and ventilation while providing an open clear view looking out or for concealing the interior contents in the event that the roll-up garage door is disabled in the open position. The panels may be locked to provide a degree of security.

Figure 1:
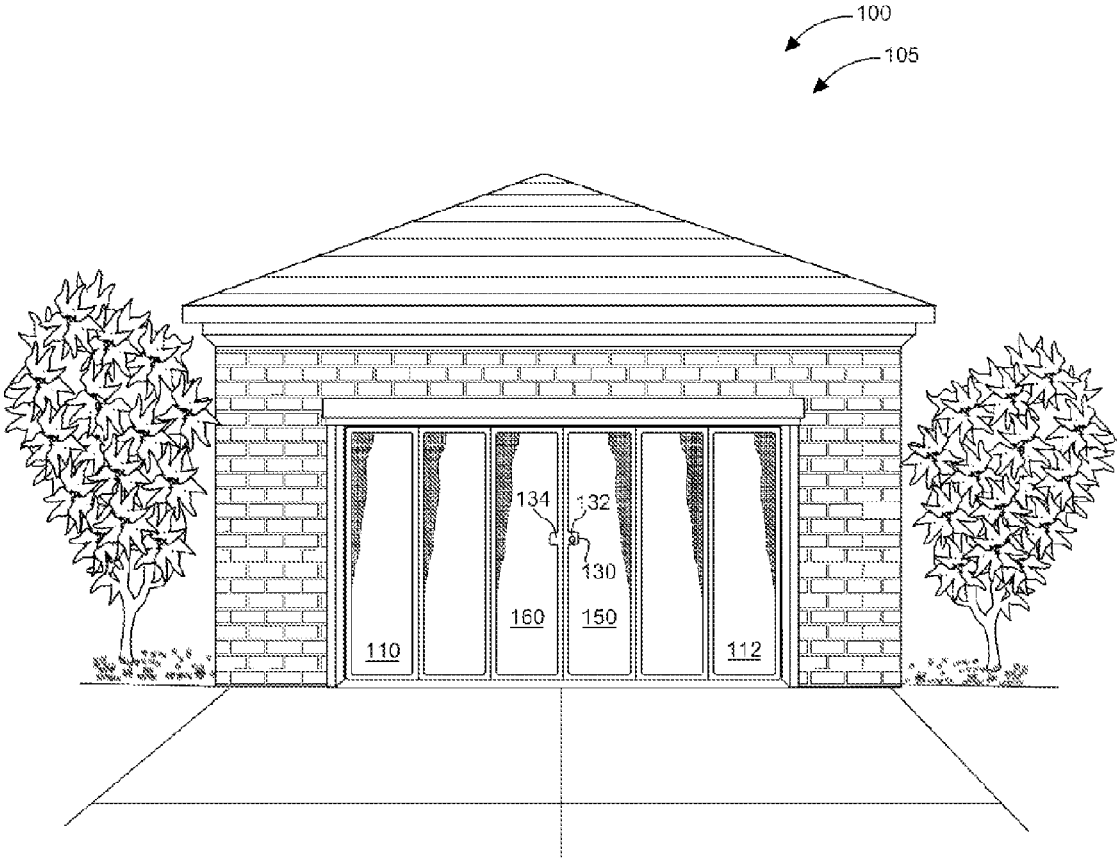
FIG. 1 shows a perspective view illustrating an in use condition of a garage opening privacy screen system according to an embodiment of the present invention.

Referring to the drawings by numerals of reference there is shown in FIG. 1, a perspective view illustrating an in use condition of garage opening privacy screen system 100 according to an embodiment of the present invention.

Privacy screen assembly 105 is useful for rollably aligning the plurality of screen panels 110 end to end within the garage door opening and locking together to provide a privacy barrier while having air flow-through and a one-way view from the inside looking out and providing a degree of security for the user. Screen panel 110 rectangular border 120 may be constructed of a metal alloy or some other rigid material so that a degree of security is provided but some embodiments may be constructed having fabric screen panel(s) 110 for privacy as the main concern.

Figure 2:
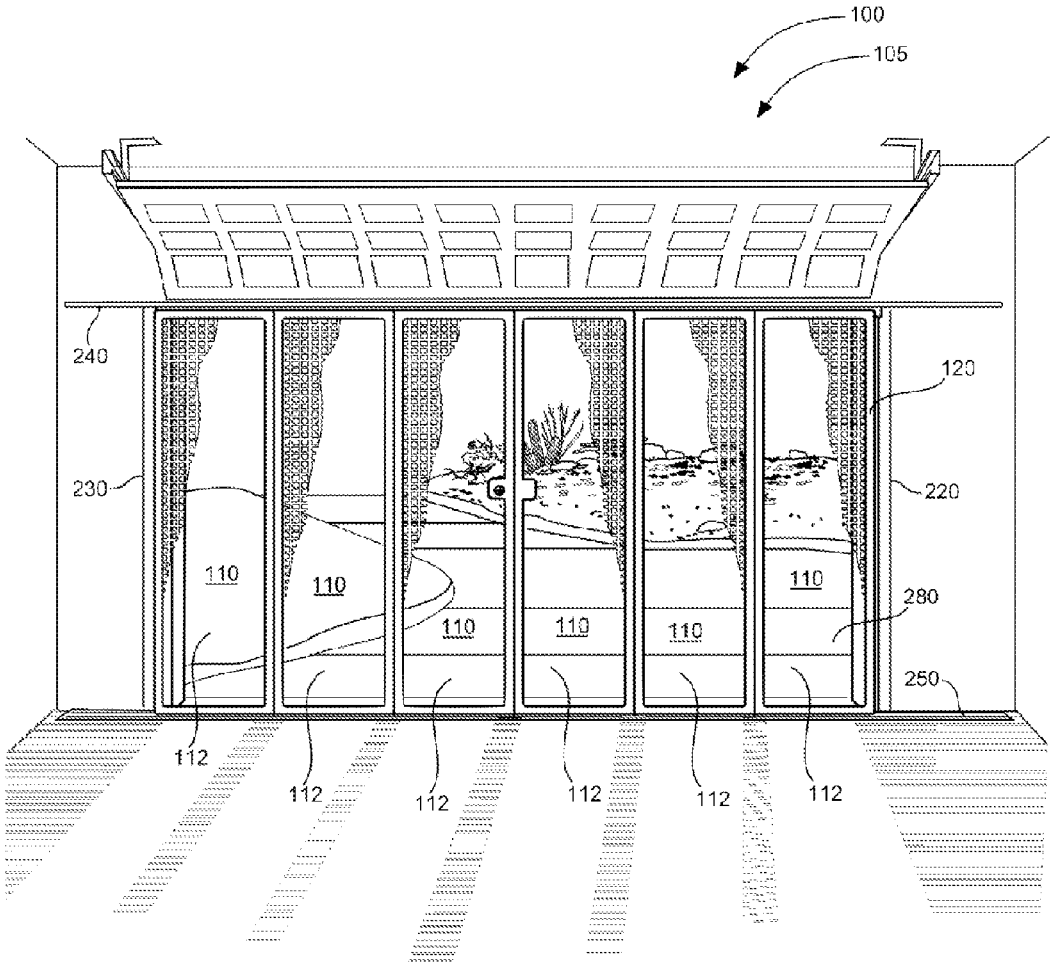
FIG. 2 is a perspective view illustrating an 'inside-looking-out' view of the garage opening privacy screen system according to an embodiment of the present invention of FIG. 1.

Referring now to FIG. 2, a perspective view illustrating an 'inside-looking-out' view of garage opening privacy screen system 100 according to an embodiment of the present invention of FIG. 1.

Screen panel(s) 110 may provide a privacy bather having a mesh such that the user is able to see outwardly through privacy screen 112 from inside the garage and alternately not able to see inwardly through privacy screen 112 from outside the garage. First half 132 of screen panel lock 130 is mounted in left stile 140 of first screen panel 150 and second half 134 of screen panel lock 130 is mounted in right stile 142 of second screen panel 160 such that first screen panel 150 and second screen panel 160 are able to be locked together when first screen panel 150 and second screen panel 160 are in the centermost position within the garage door opening. Screen panel(s) 110 may comprise hinges in some embodiments and may be able to fold accordion style into a storage position with each screen panel(s) 110 of the left side of the garage door opening parallel planar to each other and each screen panel(s) 110 of the right side of the garage door opening parallel planar to each other. Gripping and pulling a first screen panel 150 and second screen panel 160 towards the center of the garage roll-up door opening rolls all other screen panel(s) 110 into the closed position.

Figure 3:
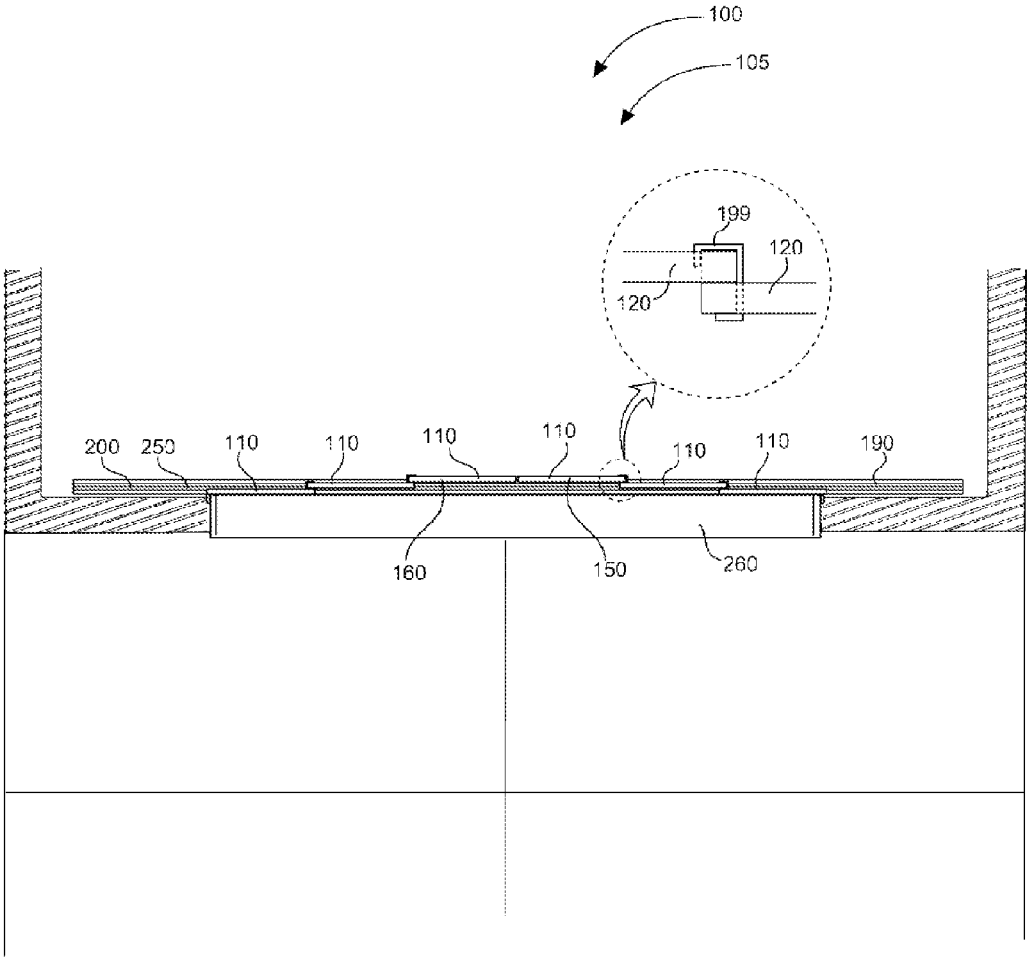
FIG. 3 is an overhead view illustrating an extended screen panel position of the garage opening privacy screen system according to an embodiment of the present invention of FIG. 1.

Referring now to FIG. 3, an overhead view illustrating an extended screen panel(s) 110 position of garage opening privacy screen system 100 according to an embodiment of the present invention of FIG. 1.

Upper rail wheels 170 and lower rail wheels 180 for each of screen panel(s) 110 are aligned linearly and are coplanar from screen panel 110 to screen panel 110. Upper 170 and lower rail wheels 180 of each screen panel(s) 110 may be able to roll in multiple U-channels 190 of first 210 and second wheel channel 200. Screen panel(s) 110 are divided such that about three screen panel(s) 110 are extended and alternately retracted from inside left garage trimmer 220 and about three screen panel(s) 110 are extended and alternately retracted from inside right garage trimmer 230. Screen panel(s) 110 are rollably located between and confined within the plane between top screen track 240 and bottom screen track 250 via upper rail wheels 170 and lower rail wheels 180 respectively, such that each of screen panel(s) 110 are parallel planar to each other and able to roll linearly within first wheel channel 210 and second wheel channel 200 to close the garage door opening. Screen panel(s) 110 may comprise screen panel limiters 199 such that when screen panel(s) 110 are extended to a closed position, a gap between screen panel(s) 110 are not present and screen panel(s) 110 are locked together on both ends.

Figure 4:
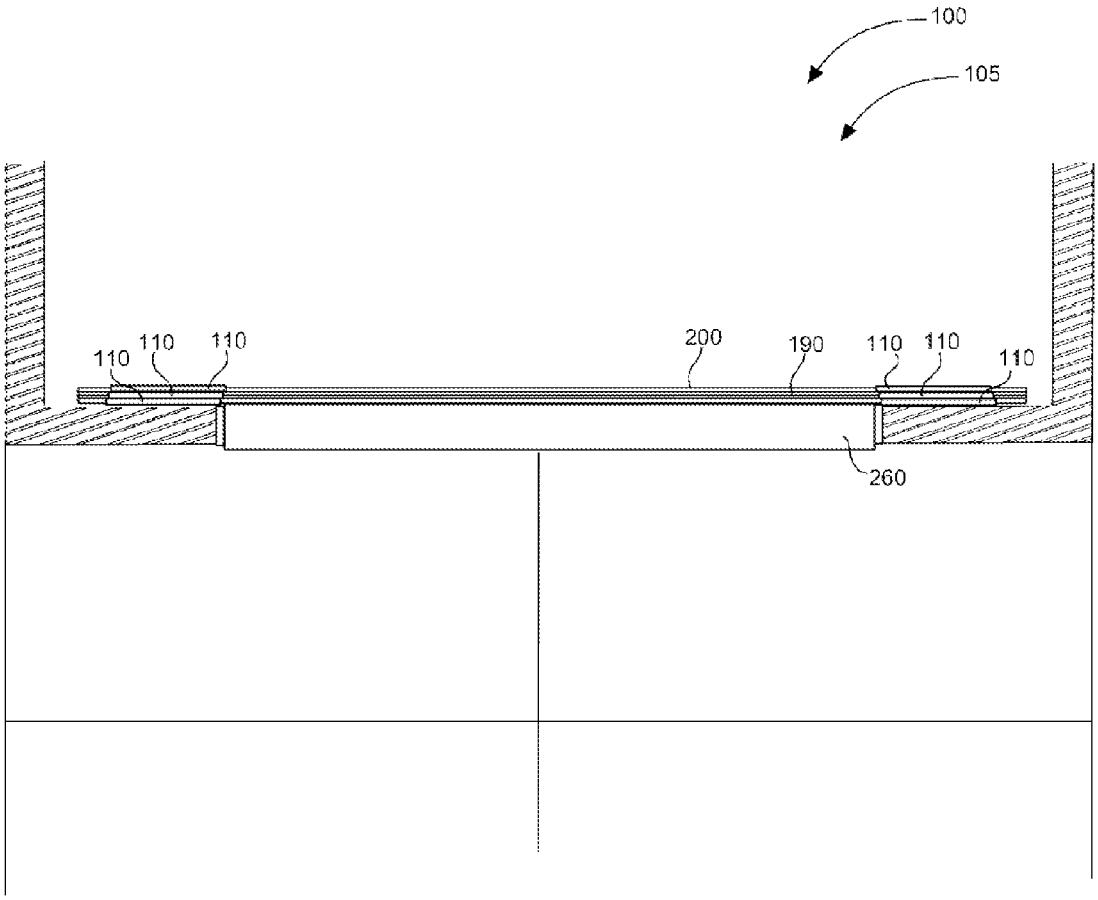
FIG. 4 is an overhead view illustrating a retracted position of the garage opening privacy screen system according to an embodiment of the present invention of FIG. 1.

Referring now to FIG. 4, an overhead view illustrating a retracted position of garage opening privacy screen system 100 according to an embodiment of the present invention of FIG. 1.

Screen panel(s) 110, when in an open condition, preferably comprise three screen panel(s) 110 adjacently parallel planar on the left side of the garage door opening and three screen panel(s) 110 adjacently parallel planar on the right side of the garage door opening. First half 132 of screen panel(s) 110 are located on the left side of the garage door opening and a second half 134 of screen panel(s) 110 are located on the right side of the garage door opening. The garage door opening is fully open and unobstructed by screen panel(s) 110 when screen panel(s) 110 are in a retracted position. Screen panel(s) 110 are auxiliary and somewhat adjacent to the roll-up garage door.

Figure 5:
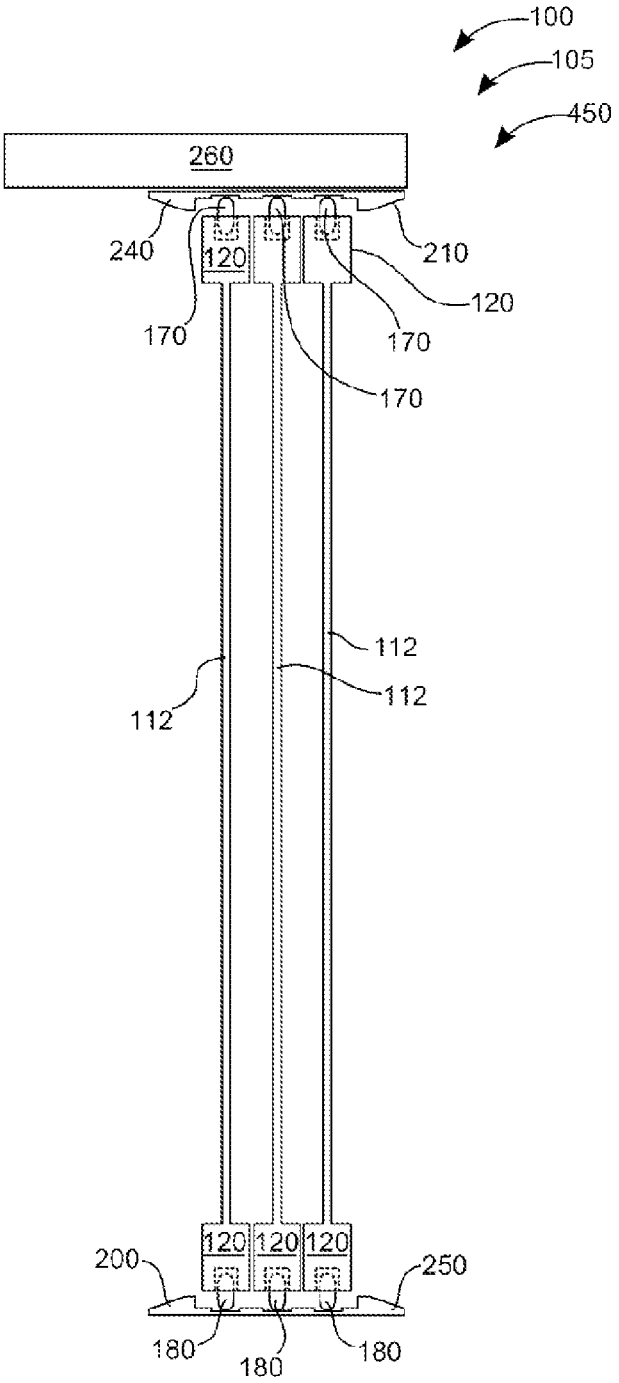
FIG. 5 is a side cutaway view illustrating the garage opening privacy screen system according to an embodiment of the present invention of FIG. 1.

Referring now to FIG. 5, a side cutaway view illustrating garage opening privacy screen system 100 according to an embodiment of the present invention of FIG. 1.

Top screen track 240 of privacy screen assembly 105 is removably fastened to a garage door opening header 260 and first wheel channel 210 is centrally and longitudinally located in the downward facing side of top screen track 240. Bottom screen track 250 of privacy screen assembly 105 is removably fastened to a garage door opening floor such that top screen track 240 and bottom screen track 250 are coplanar with each other and are parallel planar to the existing garage roll-up door when it is in a closed position. Top screen track 240 and bottom screen track 250 may further comprise multiple U-channels 190 which may be parallel to each other.

The plurality of lower rail wheels 180 of each of screen panel(s) 110 roll in multiple U-channels 190 of second screen panel 160 parallel planar to each other. Second wheel channel 200 is centrally and longitudinally located in the upward facing side of bottom screen track 250.

Figure 6:
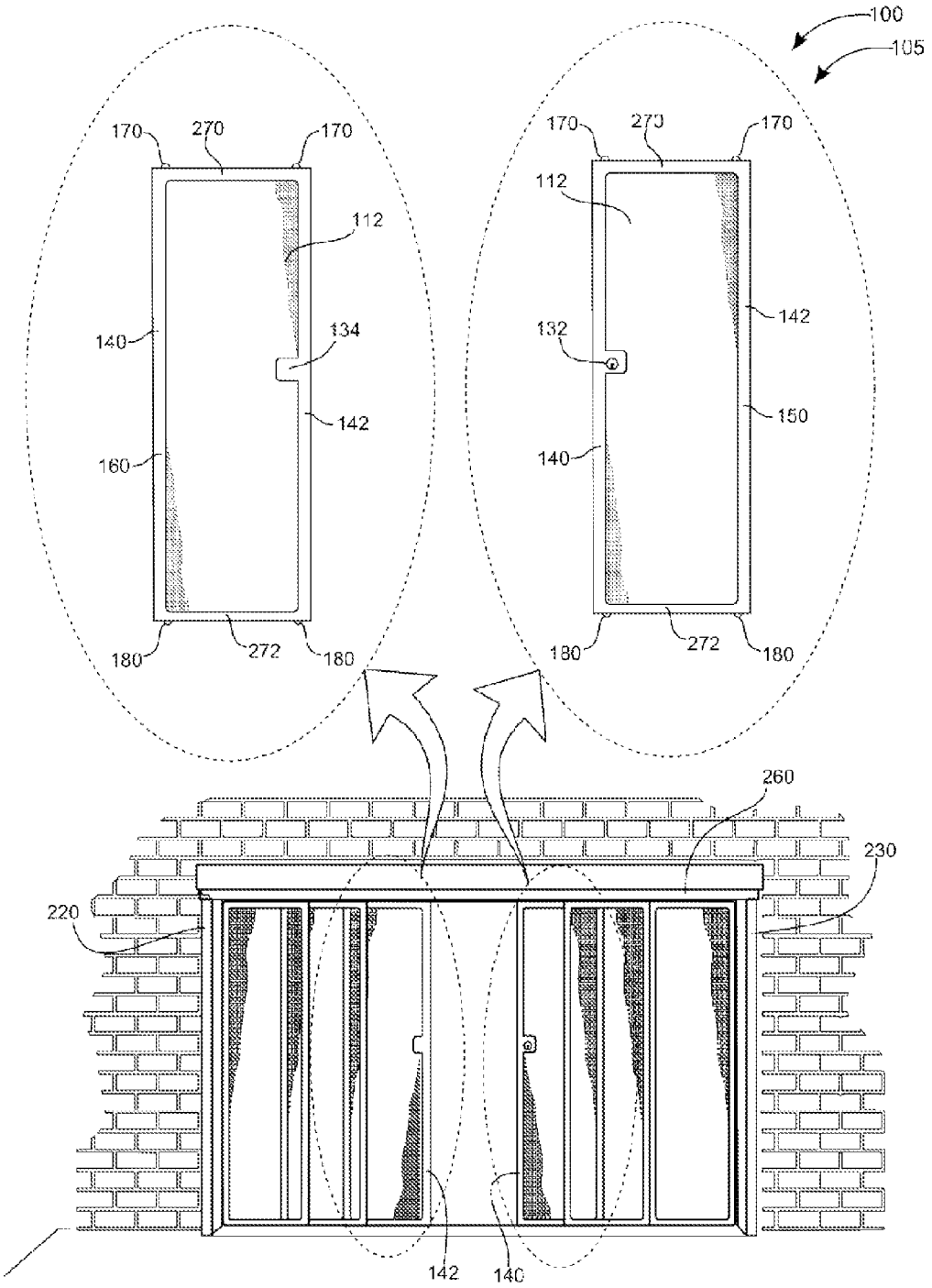
FIG. 6 is a front detail view illustrating the garage opening privacy screen system according to an embodiment of the present invention of FIG. 1.

Referring now to FIG. 6, a front detail view illustrating garage opening privacy screen system 100 according to an embodiment of the present invention of FIG. 1.

Privacy screen assembly 105 may comprise top screen track 240 having first wheel channel 210, bottom screen track 250 having second wheel channel 200, a plurality of screen panel(s) 110 each having top rail 270, bottom rail 272, left stile 140, right stile 142, a plurality of upper rail wheels 170, a plurality of lower rail wheels 180, privacy screen 112, and screen panel lock 130 (having first half 132 and second half 134). The plurality of upper rail wheels 170 are centrally and axially mounted within the top longitudinal side of top rail 270 such that upper rail wheels 170 are partially exposed above the planar surface formed by the top longitudinal side of top rail 270. Lower rail wheels 180 may be centrally and axially mounted within the bottom longitudinal edge of bottom rail 272 such that lower rail wheels 180 are partially exposed below the planar surface formed by the bottom longitudinal edge of bottom rail 272.

Each of top rail 270, bottom rail 272, left stile 140, and right stile 142 form rectangular border 120 for each screen panel(s) 110, each having rectangular screen opening 280 within an interior space formed by rectangular border 120. Top rail 270, bottom rail 272, left stile 140, and right stile 142 of each screen panel 110 may comprise a metal-alloy square tubing such that each screen panel 110 resists tortional twisting.

Top rail 270, bottom rail 272, left stile 140, and right stile 142 of each screen panel(s) 110 may comprise aluminum such that screen panel(s) 110 are light weight and easy for the user to manipulate. Privacy screen 112 may also comprise a thin gauge expanded metal-alloy or fine mesh thing gauge metal alloy. In some embodiments, privacy screen 112 may comprise a textile or a fabric having a wide enough mesh that the user may be able to see through in one direction but not from the opposite side. Privacy screen 112 is non-removably attached to the inner periphery of rectangular border 120 and is co-planar to rectangular border 120. Alternate suitably equivalent materials may be used.

Garage opening privacy screen system 100 may be sold as kit 450 comprising the following parts: at least one top screen track 240; at least one bottom screen track 250; a plurality of assembled screen panel(s) 110; and at least one set of user instructions. The kit has instructions such that functional relationships are detailed in relation to the structure of the invention (such that the invention can be used, maintained, or the like in a preferred manner). Garage opening privacy screen system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 7:
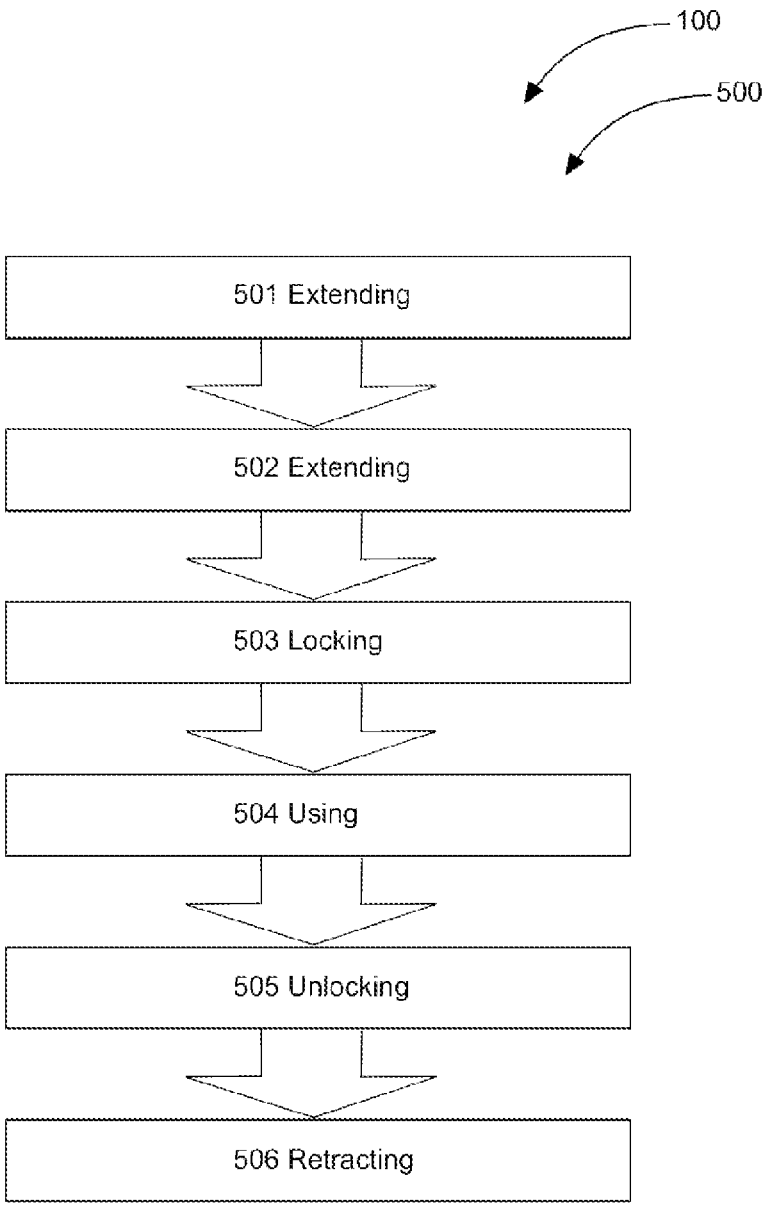
FIG. 7 is a flowchart illustrating a method of use for the garage opening privacy screen system according to an embodiment of the present invention of FIGS. 1-4.

Referring now to FIG. 7, showing method of use 500 for garage opening privacy screen system 100. A method of using garage opening privacy screen system 100 may comprise the steps of step one 501 extending screen panel(s) 110 on the left side of a garage door opening toward the center of the opening; step two 502 extending screen panel(s) 110 on the right side of the garage door opening toward the center to cover the opening; step three 503 locking screen panel(s) 110 on the left side of the garage door opening with screen panel(s) 110 on the right side of the garage door opening via screen panel lock 130; step four 504 using screen panel(s) 110; step five 505 unlocking screen panel(s) 110; step six 506 retracting screen panel(s) 110 on the left side of the garage door opening and the right side of the garage door opening for storage.

It should be noted that steps 503 and 505 are optional steps and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A combination of a garage and a garage opening privacy screen system comprising:

a garage including side walls; a back wall; a floor surface, a ceiling surface; and a front wall having a garage door opening therein defined by a first wall on one side of said opening, a second wall located on an opposite side of said opening, and a top wall defining a top edge of said garage door opening; said garage further including:

a garage door track assembly securely attached to said ceiling surface and said top wall of said front wall of said garage and being adapted to allow a garage door to be moved there along and be removably positioned within said garage door opening in opened and closed positions;

a garage door adapted to be moved along said garage door track assembly and be removably positioned within said garage door opening in opened and closed positions; and a privacy screen assembly comprising;

a top screen track securely attached to an inside surface of said front wall of said garage above said garage door opening and having three parallel elongated U-shaped channels;

a bottom screen track securely attached to said floor surface of said garage adjacent said garage door opening and having three parallel elongated U-shaped channels;

a plurality of screen panels each having;

a top rail;

a bottom rail;

a left stile;

a right stile;

a plurality of upper rail wheels;

a plurality of lower rail wheels; and a privacy screen attached between said top rail, said bottom rail, said left stile, and said right stile, and formed of a material that only allows light to pass therethrough in one direction;

wherein said plurality of screen panels comprises six screen panels, such that two screen panels releasable abut on side portions thereof and linearly roll along on, and in a parallel configuration to, a first of said three parallel elongated U-shaped channels of said top and bottom screen tracks; two screen panels linearly roll along on, and in a parallel configuration to, a second of said three parallel elongated U-shaped channels of said top and bottom screen tracks; and two screen panels linearly roll along on, and in a parallel configuration to, a third of said three parallel elongated U-shaped channels of said top and bottom screen tracks; and wherein a first of said two screen panels of said first U-shaped channels is adapted to releasably connect along a side edge with a first of said screen panels of said second U-shaped channels, and said first of said two screen panels of said second U-shaped channels is adapted to releasably connect along a side edge with a first of said screen panels of said third U-shaped channels; and a second of said two screen panels of said first U-shaped channels is adapted to releasably connect along a side edge with a second of said screen panels of said second U-shaped channels, and said second of said two screen panels of said second U-shaped channels is adapted to releasably connect along a side edge with a second of said screen panels of said third U-shaped channels;

wherein when said screen panels are in a closed position they are in a side-by-side configuration and covering the entire length of said garage door opening and allow light to pass into said garage but not outwardly therefrom; and wherein when in an open position said first panels of said U-shaped channels are overlapped and positioned completely behind said first wall of said garage door opening, and said second panels of said U-shaped channels are overlapped and positioned completely behind said second wall of said garage door opening, such that said plurality of said screen panels are not visible from outside said garage; and a screen panel lock having a first half and a second half, wherein said first half is attached to a leading edge of said first of said two screen panels of said first U-shaped channels, and said second half is attached to a leading edge of said second of said two screen panels of said first U-shaped channels, such that when said plurality of screen panels are in said closed position they can be securely locked together and prevent entrance into said garage when said garage door is in an open position;

wherein said top screen track and said bottom screen track are coplanar with each other and said top screen track and said bottom screen track are parallel planar to said garage door when said garage door is in a closed position;

wherein said upper rail wheels and said lower rail wheels for each of said plurality of screen panels are aligned linearly;

wherein said plurality of screen panels are rollably located between said top screen track and said bottom screen track via said upper rail wheels and said lower rail wheels respectively, such that each of said screen panels are parallel planar to each other and able to roll linearly within said first wheel channel and said second wheel channel to close a garage door opening;

wherein said privacy screen assembly is adapted to provide a privacy screen having air flow-through and a one-way view from an inside looking out while providing security for a user.

2. The garage opening privacy screen system of claim 1 wherein said plurality of upper rail wheels are centrally and axially mounted within a top longitudinal side of said top rails such that said plurality of wheels are partially exposed above a planar surface formed by said top longitudinal side of said top rails.

3. The garage opening privacy screen system of claim 1 wherein said plurality of lower rail wheels are centrally and axially mounted within a bottom longitudinal edge of said bottom rails such that said plurality of wheels are partially exposed below a planar surface formed by said bottom longitudinal edge of said bottom rails.

4. The garage opening privacy screen system of claim 1 wherein said privacy screen comprises textile.

5. The garage opening privacy screen system of claim 1 wherein said plurality of screen panels comprise screen panel limiters such that when said plurality of screen panels are extended, a gap between said screen panels is not present.

6. The garage opening privacy screen system of claim 1 wherein said garage opening is fully open and unobstructed by said screen panels when said screen panels are in a retracted position.

7. The garage opening privacy screen system of claim 1 further comprising a kit including:

said top screen track;

said bottom screen track;

said plurality of assembled screen panels; and at least one set of user instructions.

8. The garage opening privacy screen system of claim 1 wherein said top rail, said bottom rail, said left stile, and said right stile of each said screen panel comprise metal-alloy square tubing such that each said screen panel resists tortional twisting.

9. The garage opening privacy screen system of claim 8 wherein said privacy screen comprises thin gauge expanded said metal-alloy.

10. The garage opening privacy screen system of claim 8 wherein said top rail, said bottom rail, said left stile, and said right stile of each said screen panel comprise aluminum such that said screen panels are light weight and easy for said user to manipulate.

* * * * *